United States Patent [19]

Noe et al.

[11] 3,962,894

[45] June 15, 1976

[54] METHOD OF AND APPARATUS FOR STRETCHING A METAL STRIP

[75] Inventors: Oskar Noe; Herbert Lux, both of Mulheim (Ruhr), Germany

[73] Assignee: BWG Bergwerk-und Walzwerk Maschinenbau G.m.b.H., Duisburg, Germany

[22] Filed: May 29, 1975

[21] Appl. No.: 581,767

[30] Foreign Application Priority Data

Aug. 16, 1974 Germany ..... 2439260

[52] U.S. Cl. ..... 72/19; 72/205; 72/161; 72/249

[51] Int. Cl.[2] ..... B21D 1/05; B21D 1/02

[58] Field of Search ..... 72/205, 19, 161, 249

[56] References Cited

UNITED STATES PATENTS

| | | | |
|---|---|---|---|
| 2,432,828 | 12/1947 | Stone | 72/160 |
| 3,261,191 | 7/1966 | Wasson | 72/12 X |
| 3,559,431 | 2/1971 | Noe et al. | 72/8 |
| 3,766,767 | 10/1973 | Rastelli | 72/249 |

*Primary Examiner*—Milton S. Mehr
*Attorney, Agent, or Firm*—Karl F. Ross; Herbert Dubno

[57] ABSTRACT

A metal strip is spanned over a plurality of rollers carried on a pair of frames. A single heavy-duty drive motor rotates a common drive shaft that is connected via bevel gearing to the sun gears of a plurality of planetary-gear assemblies each having its planet carrier connected to the respective roller. The ring gear of one of these assemblies is fixed whereas the ring gears of all of the other assemblies are connected to respective compensating motors. A torque sensor at the output of each compensating motor generates an actual value signal indicating the amount of torque being applied by that motor to the respective ring gear. The comparator compares this actual-value signal with a set point coming from a single set-point generator and varies the motor speed in accordance with the difference between these two signals.

12 Claims, 2 Drawing Figures

A
1
2
3a
3b
3c
3d
3e
3f
3g
3h
4
14

TORQUE SENSOR
ACTUAL-VALUE SIGNAL
SERVO
COMPARATOR
SET POINT
A
4
5
6
7
8
9
10
11
12
13
14
15
16
17

METHOD OF AND APPARATUS FOR STRETCHING A METAL STRIP

CROSS-REFERENCE TO RELATED APPLICATION

This application is related to the copending commonly assigned patent application Ser. No. 512,604 filed Oct. 7, 1974.

FIELD OF THE INVENTION

The present invention relates to a method of and apparatus for stretching a metal strip. More particulary this invention concerns a stretching system suitable for use in a construction line wherein metal strips continuously pass through the system.

BACKGROUND OF THE INVENTION

In the above-cited copending patent application there is described a system for descaling and leveling a metal strip wherein the strip is passed through a pair of succeeding pressing assemblies. In the upstream assembly the strip is subjected to a relatively low degree of longitudinal elongation, equal to the maximum descaling stretch (MDS). At the downstream assembly the extent of stretch is considerably greater so as completely to eliminate lateral bowing of the strip. Thus in accordance with my earlier invention the strip in a single pass is both completely descaled and perfectly leveled, both of these operations being carried out at levels which correspond to the ideal stretch for that operation. The maximum descaling stretch in the upstream device is between 0.5% and 1.3% and the extent of stretch in the downstream assembly is between 2% and 2.5%.

It is known to drive a metal-strip stretching device by connecting all of the rollers through a three-part differential gear assembly to a common drive shaft driven by a single large-capacity drive motor. One part of each differential gear assembly is connected to the roller, another part is connected to the drive shaft, and a third part is connected to a so-called compensating motor. The function of these compensating motors is to create the desired tension in the metal strip, as each compensating motor is driven at a speed that establishes the necessary stretch between it and the roller immediately upstream.

This system has the disadvantage that variations in the thickness of the band or in other parameters of the process create so called transverse shatter marks in the strip. This is due to the fact that the compensating motors are operated at a single ideal speed set for a particular thickness of strip, speed of displacement, and the like.

It has been suggested to overcome this by using motors which deliver constant torque. Such a system has the disadvantage that the torque is affected by a multiplicity of different process parameters and can rarely be controlled with sufficient precision. Since transmission ratios usually in the neighborhood of 1:250 or more are used it is possible for very small variations in the output torque to have a relatively large effect in the end product. Thus it is possible for a simple heating of the motor, causing a decrease in viscosity of the fluid therein, to have a relatively great effect on the quality of the finished product.

OBJECTS OF THE INVENTION

It is therefore an object of the present invention to provide an improved method of an apparatus for treating a metal strip.

Yet another object is the provision of an improved strip stretching apparatus which produces a product of very uniform quality and eliminates the above-mentioned shatter marks.

Yet another object is to provide an improved method and apparatus which overcome the above-given disadvantages.

SUMMARY OF THE INVENTION

These objects are attained according to the present invention in a system wherein means is provided to operate each of the compensating motors so that it applies a predetermined torque to the respective part of the differential gear assembly of the respective roller. More particularly this control means includes a sensor for measuring the torque applied by the respective compensating motor on the respective part of the gear assembly and for producing an actual-value signal corresponding to the measured torque. A comparator is connected to this sensor and compares the actual-value signal with a set point representing the ideal torque to be applied and generates a control output corresponding to the difference between the set points and the actual-value signal. A servo connected between the comparator and the respective compensating motor varies the motor speed in accordance with the control output.

In the apparatus according to the present invention a constant tension is maintained on the metal strip so that a very uniform stretching thereof is obtained. Any of the various external influences which could change the quality of the product are automatically compensated for at each roller so that a product of extremely uniform quality is obtained.

According to yet another feature of this invention the differential gear assemblies are of the planetary-gear type and each comprise a central sun gear connected to the drive shaft of the drive motor, a plurality of planetary gears mounted on a carrier connected to the respective roller, and a ring gear connected to the respective compensating motor. The system according to this invention is provided with one roller whose ring gear is fixed, so that all of the other rollers are regulated around this fixed rotation speed to reduce hunting to a minimum.

In accordance with a further feature of this invention the compensating motor has a shaft connected to the respective gear assembly and a torque-measuring device is provided on the shaft to genarate the actual-value signal that is fed to the above-mentioned comparator. A signal generator is provided for forming the set point and feeding it into all of the comparators for all of the rollers. Thus a simple adjustment of this generator can reset the entire stretching system. This represents an enormous saving of time over the prior-art device.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
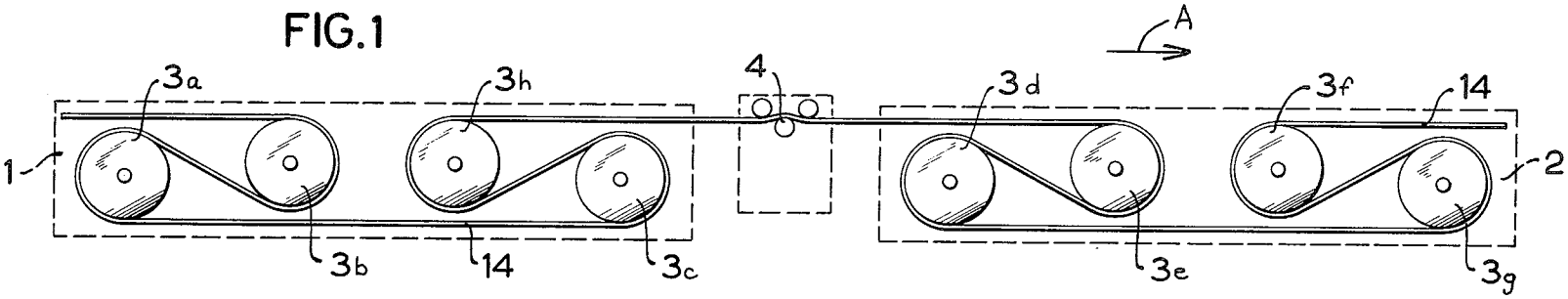
FIG. 1 is a side view illustrating the system of this invention.

As shown in FIG. 1 two frames 1 and 2 are spaced apart in a direction A of travel are fitted with a succession of rollers 3a–3h, rollers 3a, 3b, 3h, and 3c being provided on frame 1 and rollers 3d, 3e, 3f, and 3g being provided on frame 2. Between the two frames there is provided a three-roller leveler 4 that reverse bends a strip 14 spanned over all of the rollers 3a – 3g.

Figure 2:
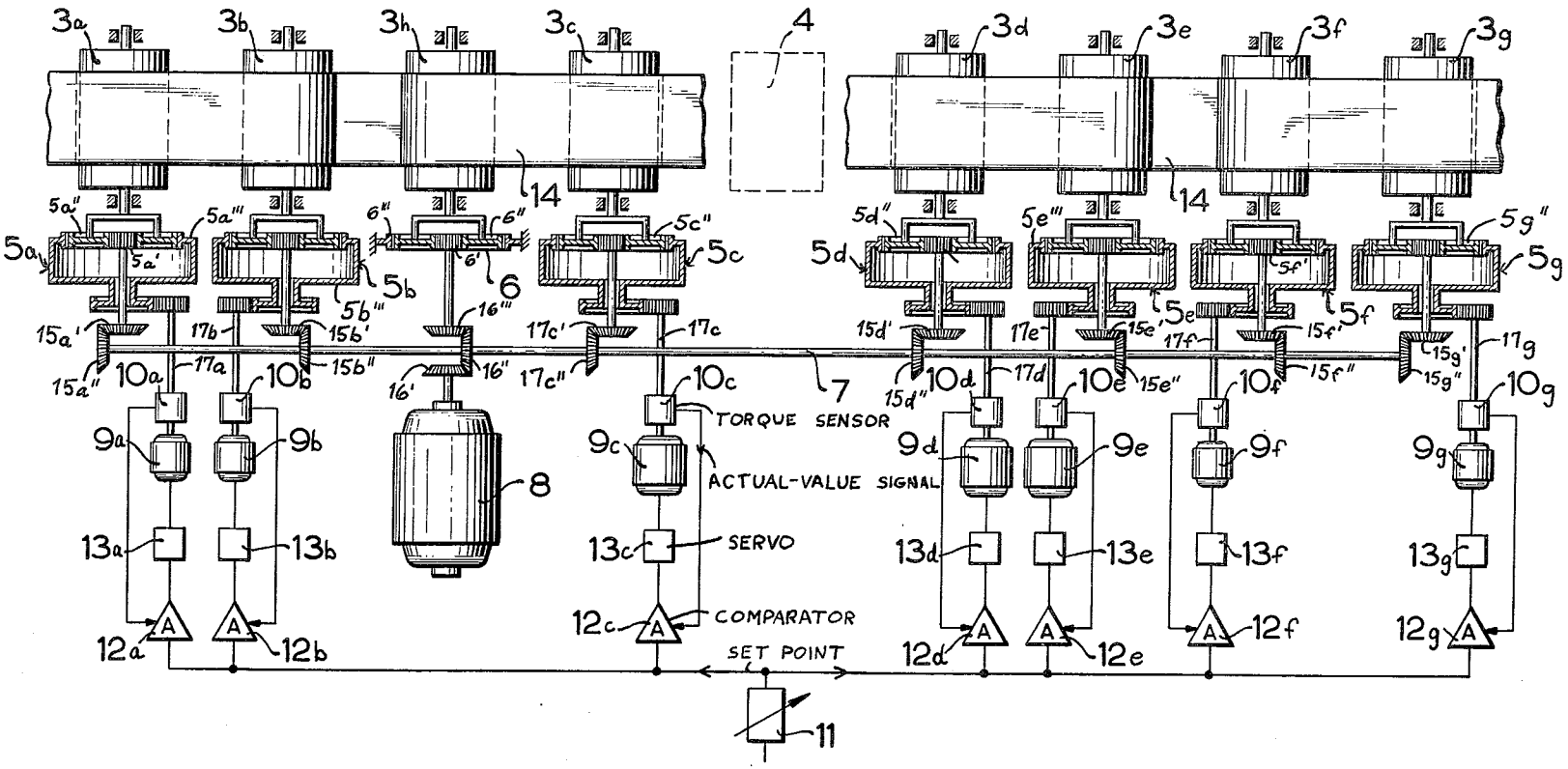
FIG. 2 is a top view, partly diagrammatic and partly in section, illustrating the system of FIG. 1.

As indicated in more detail in FIG. 2 the rollers 3a – 3g are all provided with respective planetary-gear assemblies 5a – 5g. The third roller 3h of frame 1 is connected to a respective planetary-gear system 6.

A heavy-duty drive motor 8 carries a bevel gear 16′ meshing with a bevel gear 16″ on a shaft 7 passing next to all of the planetary-gear assemblies 5a – 5g, and 6. Planetary gear assembly 6 has a sun gear 6′ connected to a bevel gear 16‴ meshing with the gear 16′ on the shaft 7. The planet carrier 6″ of the assembly 6 is connected to the respective roller 3h and the ring gear 6‴ of the assembly 6 is fixed.

In addition the shaft 7 carries bevel gears 15a″ – 15g″ which mesh with respective bevel gears 15a′ – 15g′ in turn connected to the sun gears 5a′ – 5g′ of the assemblies 5a – 5g. The planet carriers 5a″ – 5g″ of these assemblies are connected to the respective rollers 3a – 3g.

The ring gears 5a‴ – 5g‴ are connected to the far ends of shafts 17a – 17g of compensating motors 9a – 9g. Provided on each of these shafts 17a – 17g is a respective torque sensor 10a – 10g of the strain-gage type as described in SERVO MECHANISM PRACTICE by W. Ahrendt and C. Savant (McGraw Hill: 1960). The actual-value signals derived by these sensors 10a – 10g are fed to respective comparators 12a – 12g whose outputs operate respective servocontrols 13a – 13g which themselves establish the speed of the respective motors 9a – 9g. A set point from an adjustable set-point generator 11 is sent to each of the comparators 12a – 12g so that the motors 9a – 9g are automatically operated at a speed creating a torque corresponding to the set point, and when the actual-value signal from the respective torque sensor varies from the set point the motor speed is changed.

It is noted that the bevel gears 15a″, 15c″, 15d″, and 15g″ are all to one side of the respective output bevel gears and the gears 15b″, 16″, 15e″, and 15f″ are to the opposite side of the respective output bevel gears. In this manner the rollers 3b, 3h, 3e, and 3f are all rotated in a clockwise direction as seen in FIG. 1 and the rollers 3a, 3c, 3d, 3g are rotated in the counterclockwise direction.

The servomechanism 13a – 13g can be electrical, electronic, or pneumatic, or hydraulic. Thus it is possible to use a thyrister-controlled circuit arrangement, or a valve device in order to control the motors 9a – 9g, depending on whether these are electrical or hydraulic motors. In addition it is possible to use a braking dynamometer or the like instead of the strain-gage sensors 10a – 10g.

We claim:

1. An apparatus for stretching a continuously displaced elongated metal strip, said apparatus comprising:

a pair of spaced-apart frames;

at least two rollers mounted on each of said frames, said strip being spanned over all of said rollers;

a plurality of three-part differential gear assemblies each having a first part connected to a respective roller;

a drive motor;

a drive shaft operatively connected between the second parts of all of said gear assemblies and said drive motor;

a plurality of compensating motors each operatively connected to the third part of a respective assembly; and a plurality of control means each connected to a respective compensating motor for operating same so that it applies a predetermined torque to the respective third part.

2. The apparatus defined in claim 1 wherein each of said control means includes:

sensor means for measuring the torque applied by the respective compensating motor on the respective third part and producing an actual-value signal corresponding to the measured torque, comparator means for comparing said actual-value signal with a set point representing the ideal torque to be applied and for forming a control output corresponding to the difference between said set point and said actual-value signal, and servo means connected between said comparator means and the respective compensating motor for varying the motor speed in accordance with said control output.

3. The apparatus defined in claim 2, further comprising:

another such roller on one of said frames, said strip also being spanned over said other roller;

another such three-part differential gear assembly having a first part connected to said other roller, a second part connected to said drive shaft; and means preventing rotation of the third part of said other assembly.

4. The apparatus defined in claim 2 wherein said assemblies are planetary-gear assemblies each having a sun gear, a ring gear, and a planet carrier with at least one planet gear interconnecting the respective sun and ring gears.

5. The apparatus defined in claim 4 wherein said first parts are said planet carriers, said second parts are said sun gears, and said third parts are said ring gears.

6. The apparatus defined in claim 4 wherein said shaft carries a plurality of bevel gears, said second parts being provided with bevel gears meshing with the bevel gears of said shaft.

7. The apparatus defined in claim 4, further comprising a three-roller leveler between said frames, said strip passing through said leveler.

8. The apparatus defined in claim 4, further comprising means for generating said set point and for feeding same to all of said comparator means.

9. The apparatus defined in claim 8 wherein said means for generating is adjustable to vary said set point.

10. The apparatus defined in claim 4 wherein each compensating motor has an output shaft with a far end connected to the respective third part, said sensor means of the respective control means being provided on the respective shaft of the respective compensating motor.

11. A method of treating an elongated metal strip in an apparatus wherein the strip is passed over a plurality of rollers each rotated by a first part of a respective three-part differential gear assembly having a second part driven by a common heavy-duty drive motor and a third part driven by a respective compensating motor, said method comprising the steps of:

measuring the torque applied by each compensating motor on the respective third part of the respective assembly and generating a respective actual-value signal corresponding thereto, comparing said actual-value signal with a set point representing the desired torque level and generating a control output corresponding to the difference between said actual-value signal and said set point, and varying the output speed of said motor in accordance with said control output.

12. The method defined in claim 11, further comprising the steps of passing said strip over yet another roller and driving said other roller at a fixed speed.

* * * * *